United States Patent [19]

Babitzka et al.

[11] Patent Number: 4,779,596

[45] Date of Patent: Oct. 25, 1988

[54] DEVICE FOR INJECTING FUEL INTO COMBUSTION CHAMBERS OF INTERNAL COMBUSTION ENGINES

[75] Inventors: Rudolf Babitzka, Kirchberg; Ernst Linder, Mühlacker; Wilhelm Polach, Möglingen, all of Fed. Rep. of Germany

[73] Assignee: Robert Bosch GmbH, Stuttgart, Fed. Rep. of Germany

[21] Appl. No.: 887,824

[22] PCT Filed: Oct. 25, 1985

[86] PCT No.: PCT/DE85/00417

§ 371 Date: Jul. 10, 1986

§ 102(e) Date: Jul. 10, 1986

[87] PCT Pub. No.: WO86/02979

PCT Pub. Date: May 22, 1986

[30] Foreign Application Priority Data

Nov. 10, 1984 [DE] Fed. Rep. of Germany ..... 3441140

[51] Int. Cl.[4] ..... F02M 39/00

[52] U.S. Cl. ..... 123/472; 123/467; 123/500; 123/496

[58] Field of Search ..... 123/357–359, 123/467, 496, 499, 446, 472

[56] References Cited

U.S. PATENT DOCUMENTS

| | | | |
|---|---|---|---|
| 4,275,693 | 6/1981 | Leckie | 123/472 |
| 4,359,032 | 11/1982 | Ohie | 123/467 |
| 4,438,496 | 3/1984 | Ohie | 123/472 |
| 4,640,252 | 2/1987 | Nakamura | 123/467 |
| 4,669,429 | 6/1987 | Nishida | 123/447 |

FOREIGN PATENT DOCUMENTS

| | | | |
|---|---|---|---|
| 711940 | 9/1941 | Fed. Rep. of Germany | 123/467 |
| 1576570 | 3/1970 | Fed. Rep. of Germany | 123/500 |
| 59-101575 | 10/1984 | Japan | 123/500 |
| 622224 | 4/1949 | United Kingdom | 123/467 |

*Primary Examiner*—Carl Stuart Miller

*Attorney, Agent, or Firm*—Michael J. Striker

[57] ABSTRACT

Device for injecting of fuel into internal combustion engines with an injection jet is provided with a stretched tension wire as a locking spring element for an outwardly opening valve locking member. The pretension of the tension wire is influenced by the current flow in an electrical current circuit which is fed to an electric resistor element being installed into the injection jet. The resistor element may be formed by the tension wire itself or by coil of an electromagnet, whose anchor is coupled with the tension wire. Thus, the opening pressure ($P_ö$) of the injection jet or the injection process can be controlled in a simple manner or may be formed accurately in accordance with a predetermined principle.

7 Claims, 2 Drawing Sheets

Figure 1:
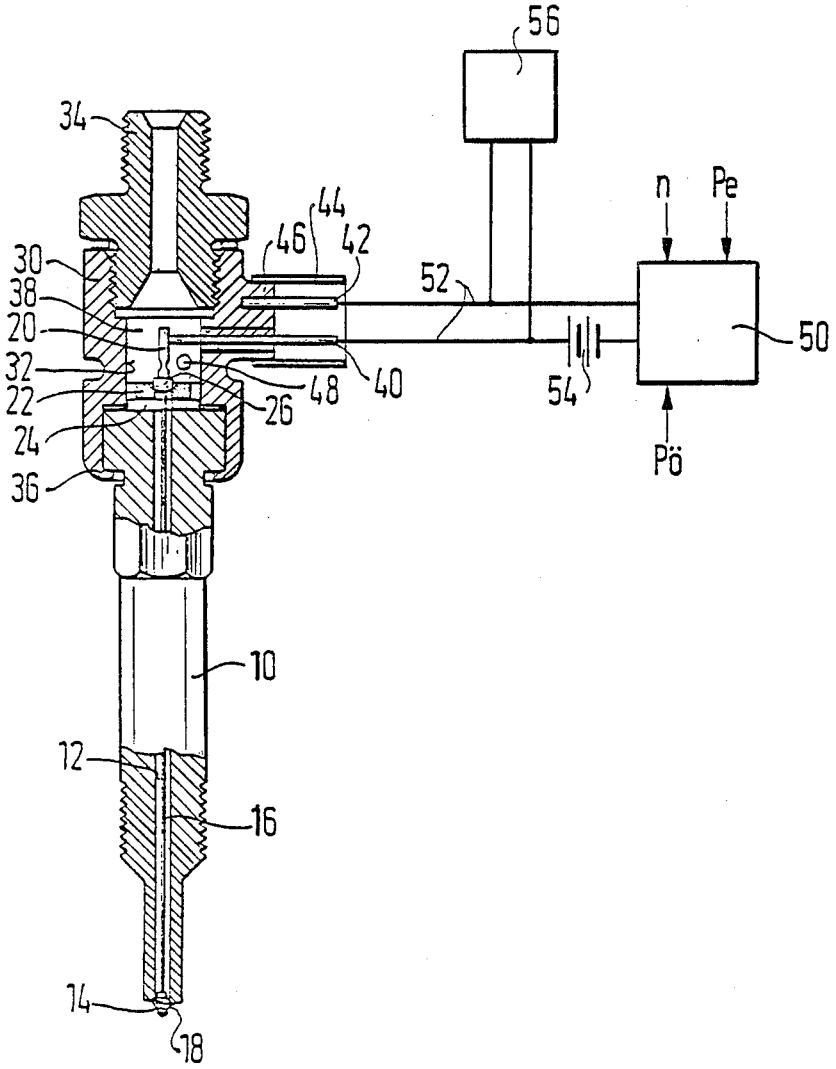

DEVICE FOR INJECTING FUEL INTO COMBUSTION CHAMBERS OF INTERNAL COMBUSTION ENGINES

STATE OF THE ART

The invention relates to a device for injecting fuel in internal combustion engines. In known devices of this type the locking force of the locking spring element can be changed by an axial displacement of its housing mounted support shoulder, however relatively expensive means are required. In furtherance, devices of the type are known (DE-A1-33 44 396.3) wherein the injection for forming a clearly defined preinjection phase is shortly interrupted in a defined range of the operating performance graph. In these devices it is relatively difficult to adjust with respect to each other the parameters with respect to each other which influence the operation of the injection. Furthermore, the state of the art also recognizes injection jets (DE-OS 15 76 570) which have a stretched tension wire as a locking spring element. With this design of the locking spring element a high inherited frequency of the oscillating system may be obtained consisting of the valve locking member and the locking spring element, however the locking force of the tension wire can only be adjusted, but cannot be changed during the operation of the engine.

ADVANTAGES OF THE INVENTION

In contrast thereto the inventive arrangement with the characterizing features of the main claim is advantageous in that with simple or accurately controllable means the opening pressure of the injection jet or the injection process during the operation can be changed. Moreover, there is also a high spring stiffness of the locking spring element.

In keeping with these objects and others, one feature of the invention resides in a device for injecting fuel into combustion chambers of internal combustion engines, comprising an injecting element including a valve body provided with a valve seat, a valve member displaceable in the valve body so that to open the valve seat in a flow direction of a fuel, and a closing element acting upon the valve body opposite to a fuel pressure; and means for changing a closing force of the closing element and thereby changing a fuel opening pressure during running of an internal combustion engine, the closing element being formed as a tension wire, and changing means including an electrical current circuit and a resistor arranged so as that electrical current circuit supplies a current flow via the electrical resistor element to the tension wire so as to change its pretensioning and therefore to change the closing force of the closing element.

One embodiment which does not require any additional mechanical means is obtained if the electric resistance element is formed by the tension wire itself, so that the current throughput through the tension wire is changeable in measurably influencing manner of its locking force or is controllable in accordance with a predetermined mathematical interrelationship.

The opening pressure of the injection jet can be controlled when the injection jet is provided with a sensor which picks up the opening pressure and, if need be, with a sensor which picks up the lifting off of the valve locking member from the valve seat. This second sensor may be a switch formed by the valve locking member and the valve seat and which advantageously may also be used as an injection starter transmitter or a constant injection transmitter for an evaluation circuit.

The injection process itself may be influenced or shaped by means of a temporary intervention in accordance with a defined mathematical principle if the electric resistance element which changes the pretension of the tension wire is the coil of a magnet, whose anchor is coupled with the tension wire and acts on the tension wire in the locking direction during its initial pulling movement.

DRAWING

Two exemplified embodiments are illustrated in the drawing and explained in more detail in the following description.

Figure 2:
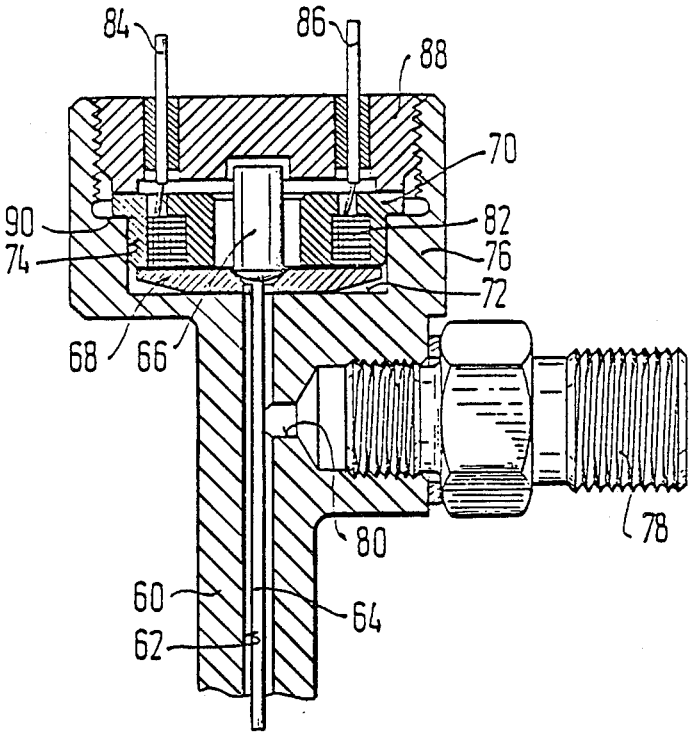
Figure 3:
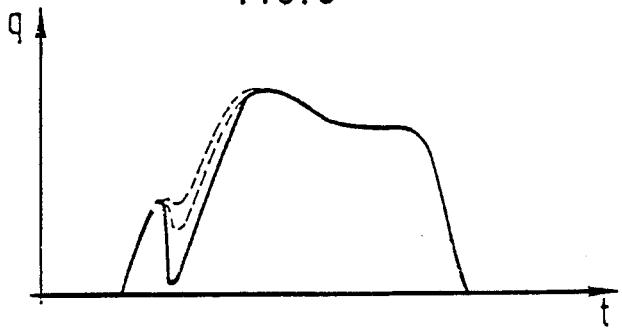

FIG. 1 illustrates the injection jet of the first exemplified embodiment in a longitudinal section with the power circuits for the electrical functions of the device, FIG. 2 illustrates a partial longitudinal section through the injection jet in accordance with the second embodiment, and FIG. 3 is an operational diagram of the injection jet in accordance with FIG. 2.

DESCRIPTION OF THE EXEMPLIFIED EMBODIMENTS

The injection jet in accordance with FIG. 1 has a jet body 10 which is provided with a continuous longitudinal bore 12 which at the side of the combustion chamber forms an outwardly directed conical valve seat 14. A tension wire 16 extends within the longitudinal bore 12 and is rigidly connected with a cone shaped locking member 18 so as to form its locking spring. On the other end the tension wire 16 is fixedly connected with a bolt 20 which has a larger diameter and simultaneously used for a housing support and for an electrical contacting of the tension wire 16. For supporting purposes a support disk 22 is provided which consists of electrically insulating material and supports on the upper front face of the jet body 10 by means of an intermediary disc. Preferably, the bolt 20 has a thicked head 26 with a ball shaped arched surface which is positioned in a correspondingly shaped recess of the support disk. Thereby, and due to the cone shaped design of the valve seat 14 an automatic centering of the valve seat locking member 18 on valve seat 14 is obtained.

The jet body 10 is fixedly and tightly connected with a jet support 30 which is provided with a central bore 32. The bore at the input side has a threaded bore portion, and a connecting socket 34 for a fuel feeding line is screwed in it. At the output side the bore 32 has a bore portion of a larger diameter encompassed by a flange collar 36 of the jet support 30 and engaging the jet body 10. Due to this arrangement a chamber 38 is formed inside of the jet support 30. The chamber 38 filled with fuel and connected with the longitudinal bore 12 which leads to the valve seat 14 by means of apertures, not illustrated, in the support disk 22 and the intermediary disk 24.

The bolt 20 which is mounted on tension wire 16 consists of electrically conductive material as does the tension wire itself and is contacted with a connecting pin 40 which extends laterally the chamber 38 in a pressure tight manner. The housing of the injection jet which consists of the jet body 10, the jet support 30 and the connecting socket 34 is provided with a second connecting pin 42. Both connecting pins 40,42 are encompassed by a protective capsule 44 which is placed on a lateral extension 46 of the jet support 30 in a nondetachable manner. Furthermore, a receiving socket for a pressure sensor 48 is mounted on the jet body 30 offset by about 90° with respect to the extension 46. It picks up the fuel pressure in chamber 38 and reports as an electrical signal to a control 50.

The control 50 is switched in a circuit 52 of a power source 54 which leads through the tension wire 16 and parts 14,18 acting as switches to the valve which is formed on the jet opening. The power which flows in the circuit 52 heats the tension wire, whereby its pretension force or locking force changes with the power intensity. The control 50 controls the power intensity in accordance with speed n and a parameter $P_e$ which signals the load of the engine, whereby the actual value of the fuel pressure in the injection jet is constantly reported back to the control 50. Advantageously, the control range is so selected that the temperature influences of the jet body 10 and the fuel which is present in the longitudinal bore 12 have a rather low influence on the quality of the control.

Furthermore, an evaluation circuit 56 for the signal pulses generated on the jet opening by the opening and locking of valves 14, 18 is connected to the power circuit 52 in a suitable manner. These signal pulses may be evaluated for determining the start of the injection or the duration of the injection in the different operating conditions. The signal pulse which is generated during the opening of the valve in cooperation with pressure sensor 48 is used for the accurate determination of the fuel opening pressure $P_{\ddot{o}}$ in devices wherein the fuel pressure still increases after the opening of the valve.

A simple embodiment of the injection jet had been selected as an exemplified embodiment. For eliminating a stress of the tension wire 16 beyond its elasticity limit the support disk 22 could be supported by means of a corresponding pretensioned screw spring on jet body 10. Furthermore, the bolt 20 could also be axially adjustable with the tension wire 16 for the purpose of adjusting the locking force.

The injection jet in accordance with FIG. 2 has a jet body 60 with a central bore 62 which forms an outwardly directed conical valve seat at the combustion chamber side in the same manner as the longitudinal bore 12. A tension wire 64 extends through longitudinal bore 62 and is connected with the valve locking member to form its locking spring. On the other end the tension wire 64 is fixedly connected with a bolt 66 which has a larger diameter and which supports on a shoulder 72 of the jet body 60 by means of an anchor disk 68 of an electromagnet 70. The shoulder 72 is formed at the transition of the longitudinal bore 62 into a bore 74 which is larger in its diameter and is formed in an enlarged head portion 76 of the jet body 60 which receives the electromagnets 70. The fuel is led laterally through a connecting socket 78 and a transverse bore 80 into the longitudinal bore 62 and therethrough to the valve seat and to the output jet opening.

The electromagnet 70 has a coil 82 which is connected with a control power circuit by means of connecting contacts 84,86. The connecting contacts 84,86 are electrically insulated and are fed through a disk 88 in a pressure tight manner being screwed into the head portion 76. The disk 88 pushes the housing of the electromagnet 70 against a shoulder 90 of the head portion 76, whereby these parts are sealed pressure resistant to the outside by suitable means.

The excited electromagnet 70 exerts a pulling force to the anchor disk 68, which is transmitted through the bolt 66 and to the tension wire 64 and which adds up to the pretension force of the tension wire 64 when the valve is closed. Thus, the opening pressure $P_{\ddot{o}}$ of the injection jet can be changed in the desired manner or may be varied with a corresponding design of the electromagnet 70.

However, with the arrangement in accordance with FIG. 2 it is also possible to shape the operation of the injection process, in particular to obtain a defined preinjection phase. For this purpose the electromagnet 70 will be fed with a variable current pulse shortly after the start of the injection, whereby independent from the length of the pulse the injection is temporarily throttled until it is interrupted totally and again is fully operable after the drop of magnet disk 68. FIG. 3 illustrates such an injection process as a function of the injection amount q over time t, whereby different curves illustrate the influence of the pulse length for the start of the injection 3.

We claim:

1. A device for injecting fuel into combustion chambers of internal combustion engines, comprising an injecting element including a valve body provided with a valve seat, a valve member displaceable in said valve body so that to open said valve seat in a flow direction of a fuel, and a closing element acting upon said valve body opposite to a fuel pressure; and means for changing a closing force of said closing element and thereby changing a fuel opening pressure during running of an internal combustion engine, said closing element being formed as a tension wire, and said changing means including an electrical current circuit and a resistor formed by said tension wire and arranged so that said electrical current circuit supplies a current flow via said tension wire so as to change its pretensioning and therefore to change the closing force of said tension wire.

2. A device for injecting fuel into combustion chambers of internal combustion engines, comprising an injecting element including a valve body provided with a valve seat, a valve member displaceable in said valve body so that to open said valve seat in a flow direction of a fuel, and a closing element acting upon said valve body opposite to a fuel pressure; and means for changing a closing force of said closing element and thereby changing a fuel opening pressure during running of an internal combustion engine, said closing element being formed as a tension wire, and changing means including an electrical current circuit and a resistor arranged so that said electrical current circuit supplies a current flow via said electrical resistor element to said tension wire so as to change its pretensioning and therefore to change the closing force of said closing element, said changing means including an electromagnet which has an armature coupled with said tension wire and during its initial pulling movement acting upon said tension wire in a closing direction.

3. A device as defined in claim 1; and further comprising a sensor which senses an opening pressure of the fuel, said changing means including a control element arranged to change said current flow in dependence upon the sensed opening pressure of the fuel.

4. A device as defined in claim 3; and further comprising a sensor which senses a lifting off of said valve member from said valve seat, said control element being arranged to change said current flow also in dependence upon said sensed lifting off of said valve member from said valve seat.

5. A device as defined in claim 1, wherein said valve member and valve seat together form an electric switch for a current flow through said tension wire; and further comprising an evaluating circuit connected with said switch so that the latter forms an injection start transmitter for said evaluating circuit.

6. A device as defined in claim 1, wherein said valve member and valve seat together form an electric switch for a current flow through said tension wire; and further comprising an evaluating circuit connected with said switch so that the latter forms an injection duration transmitter for said evaluating circuit.

7. A device as defined in claim 2, wherein said electromagnet has a coil forming said electrical resister element.

* * * * *